United States Patent [19]

Luen

[11] Patent Number: 4,785,892

[45] Date of Patent: Nov. 22, 1988

[54] PILE DRIVER, PILE DRAWER AND/OR DRILLING MACHINE

[76] Inventor: Lam M. Luen, 5000 Marine Parade Rod, Laguna Park, Blk., G04-27, Singapore, Singapore, 1544

[21] Appl. No.: 165,366

[22] Filed: Feb. 29, 1988

Related U.S. Application Data

[63] Continuation of Ser. No. 796,365, Nov. 8, 1985, abandoned.

[30] Foreign Application Priority Data

Nov. 8, 1984 [GB] United Kingdom ..... 8428285
Sep. 25, 1985 [GB] United Kingdom ..... 8523644

[51] Int. Cl.[4] ..... E21B 7/02
[52] U.S. Cl. ..... 173/28; 173/39
[58] Field of Search ..... 173/22, 28, 39, 42–44, 173/164; 175/135, 162, 202, 203

[56] References Cited

U.S. PATENT DOCUMENTS

| | | | |
|---|---|---|---|
| 3,172,483 | 3/1965 | Spitzer | 173/22 |
| 3,181,623 | 5/1965 | Lindgren . | |
| 3,357,502 | 12/1967 | Elliot | 173/28 |
| 3,452,829 | 7/1969 | Smith | 173/28 |
| 3,680,412 | 8/1972 | Mayer et al. | 173/164 |
| 3,754,604 | 8/1973 | Inaba et al. | 173/28 |
| 3,809,169 | 5/1974 | Hunt | 173/28 |
| 4,147,215 | 4/1979 | Hodge et al. | 173/164 |
| 4,403,666 | 9/1983 | Willis | 173/164 |
| 4,586,571 | 5/1986 | Rajakallio et al. | 173/39 |

FOREIGN PATENT DOCUMENTS 2492881 4/1982 France .

*Primary Examiner*—E. R. Kazenske
*Assistant Examiner*—James L. Wolfe
*Attorney, Agent, or Firm*—Armstrong, Nikaido, Marmelstein & Kubovcik

[57] ABSTRACT

A combined pile driver, pile drawer and drilling machine comprises a carriage (1), a turntable (1A) mounted on the carriage (1), support device (2), lifting device (4) and a mast system (5) comprising two mast units (3). The support device (2) comprises a tubular support bearing (9) which is hinged to the turntable (1A) at (6A) and the lifting device (4) comprises two hydraulic cylinder (6) which are hinged to the turntable (1A) at (6B) and to a bearing sleeve (9A) at (6C). The support device (2) further comprises a mast support (10) which surrounds the bearing (9) and extends through the sleeve (9A) and can be rotated about its own axis by means of an hydraulic cylinder (11) and a coupling (11A). Each mast unit (3) is mounted on the mast support (10) by brackets (14) and comprises a guide rail (13), a mast (12) which is slidable on the guide rail (13) by an hydraulic cylinder (15) and a cradle (30) which is movable on the mast (12) by an hydraulic feed cylinder (28). Each cradle (30) supports a rotary head or percussion head for a drilling tool or the like or a pneumatic hammer for pile driving. One of the masts (12) is also provided with a clamp (16) and a turning unit (17) for pile drawing. The machine can also be used as a crane. A hydraulic jack (37) is provided to support the weight of the mast system when the mast system is in a vertical position.

28 Claims, 13 Drawing Sheets

$\alpha = \frac{36°}{2}$

PILE DRIVER, PILE DRAWER AND/OR DRILLING MACHINE

This application is a continuation of application Ser. No. 796,365, filed 11/8/85, now abandoned.

BACKGROUND OF THE INVENTION

This invention relates to a pile driver, pile drawer and/or drilling machine for use in geological exploration, mineral prospecting, mining, foundation engineering, building and the like.

Previously proposed drilling machines for small scale drilling operations comprise a collapsible mast on a mobile chassis. One disadvantage of this arrangement is that a single mast is inadequate when a large number of holes are to be drilled, so that a number of machines must be used.

Previously proposed pile drivers, on the other hand, comprise a frame which is erected above the spot where a pile is to be driven into the ground and is provided with one or more sets of guide rails along which a heavy weight is allowed to fall onto the pile, thus driving the pile into the ground. Such pile drivers can thus only operate when the guide rails are substantially vertical, although drilling machines which can drill horizontally have been previously proposed.

A further disadvantage of previously proposed pile drivers and drilling machines is that the same machine cannot be used both for pile driving and for drilling. especially in angel pile-drill or horizontal pile-drill position.

OBJECT AND SUMMARY OF THE INVENTION

It is an object of the present invention to enable the provision of a pile driver, pile drawer and/or drilling machine for use in geological exploration, mineral prospecting, mining, foundation engineering, building and the like whereby the above disadvantages may be overcome or at least mitigated.

According to one aspect of the present invention, there is provided a machine which comprises a chassis carrying a turntable, an elongate lifting and/or tool carrying means and support means for the lifting and/or tool carrying means, wherein the support means is mounted to a surface of the turntable so as to be rotatable relative to the turntable about two non-parallel axes irrespective of the orientation of the lifting and/or tool carrying means relative to the said surface, the orientation of one of the said axes of rotation being dependent on the rotation of the support means about the other of the said axes, and wherein the lifting and/or tool carrying means is rotatable with respect to the support means.

In a second aspect, the present invention provides a machine which comprises a lifting and/or tool-carrying means and support means therefor, wherein the support means is rotatable about two non-parallel axes and comprises two members, one of which members is rotatably mounted on the other, and wherein the lifting and/or tool carrying means is fixed to the said rotatable member, the said rotatable member being rotatable by hydraulic or pneumatic means comprising two piston and cylinder arrangements pivotally connected to a first gear and operable in opposition so that, in use, when the piston of one piston and cylinder arrangement is extended and the other one is retracted semultaniuosly. the first gear rotates in one direction and when the piston of the other piston and cylinder arrangement is extended and the other one is retraced semultaniously the first gear rotates in the other direction, the first gear meshing with a second gear disposed at right angles thereto the second gear being connected for rotating the said rotatable member.

The invention also provides a machine which comprises a lifting and/or tool-carrying means and support means therefor, wherein the support means is rotatable about two mutually perpendicular axes and the lifting and/or tool carrying means is rotatable with respect to the support means.

The invention enables drilling of horizontal, slanting and vertical holes and holes of various sizes.

BRIEF DESCRIPTION OF THE DRAWINGS

For a better understanding of the present invention, and to show how the same may be put into effect, reference will now be made, by way of example, to the accompanying drawings, in which.

DETAILED DESCRIPTION OF A PREFERRED EMBODIMENT

Figure 1:
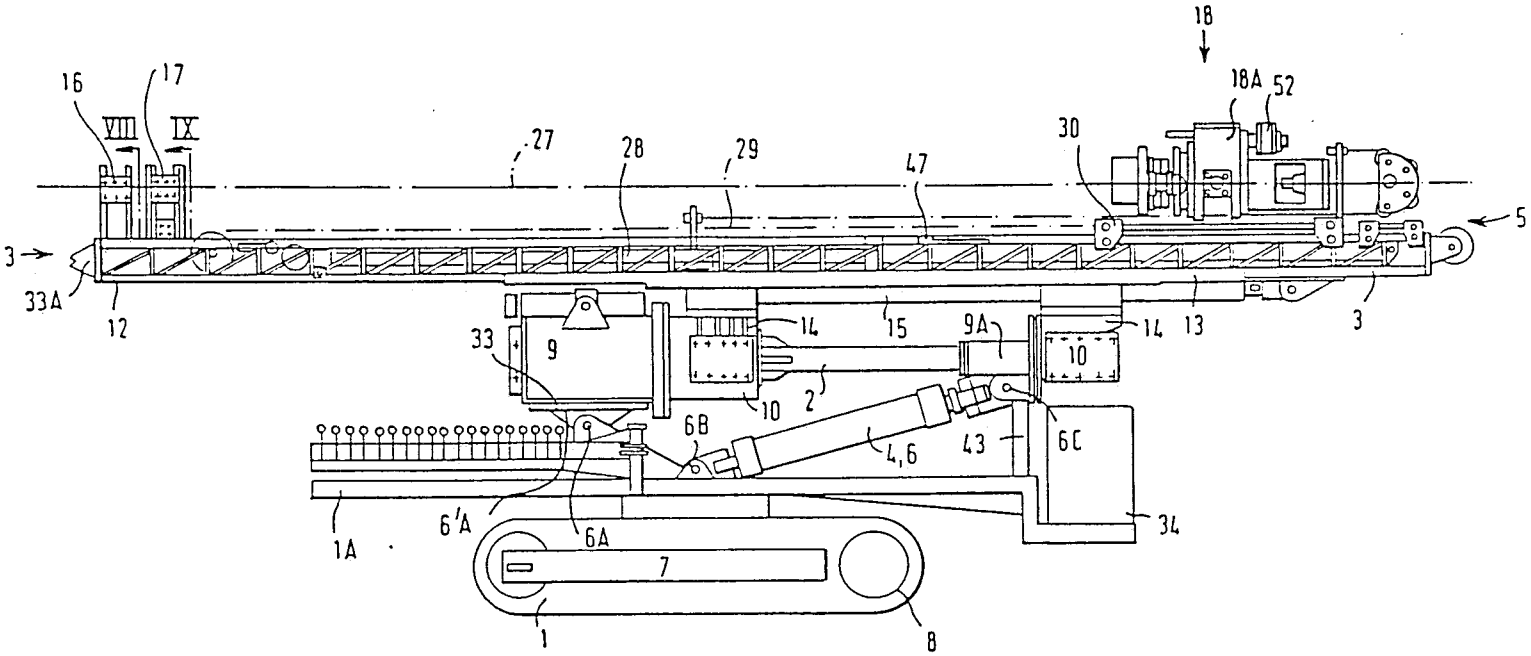
FIG. 1 is a side elevational view of a combined pile driver pile drawer and drilling machine in accordance with the invention.
Figure 2:
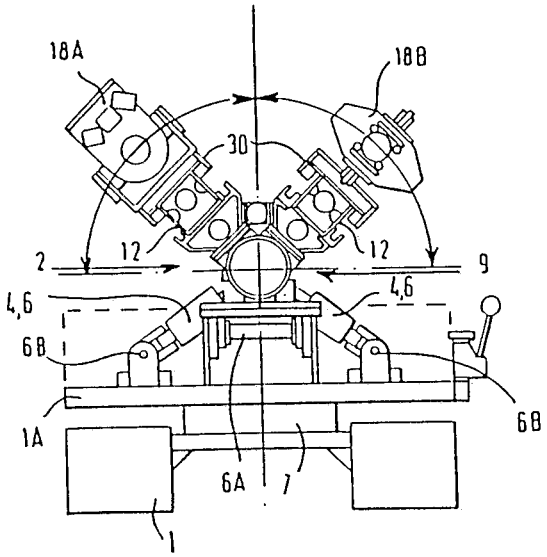
FIG. 2 is an end view of the machine of FIG. 1.
Figure 2A:
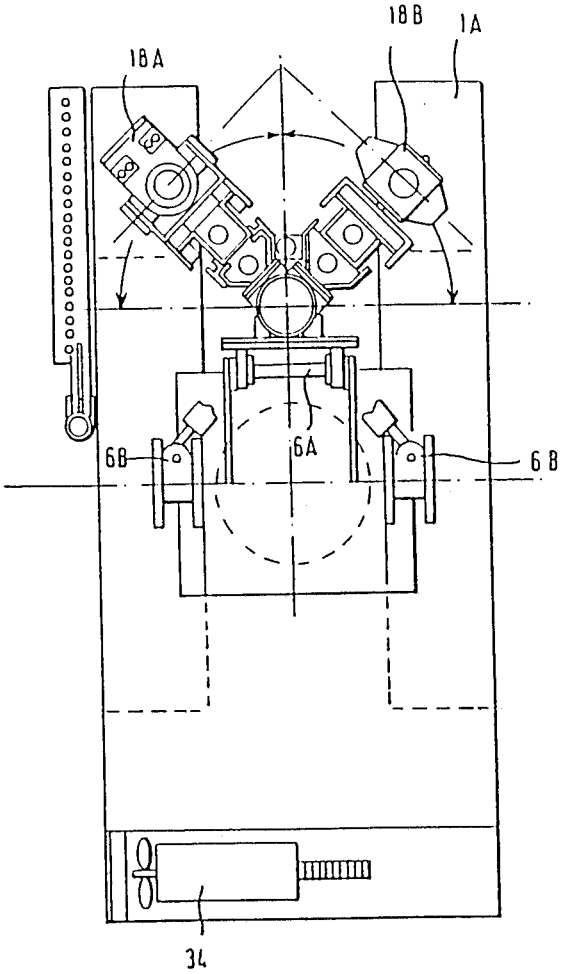
FIG. 2A is a top view of the machine of FIG. 1 when a mast thereof is in a vertical position.
Figure 3:
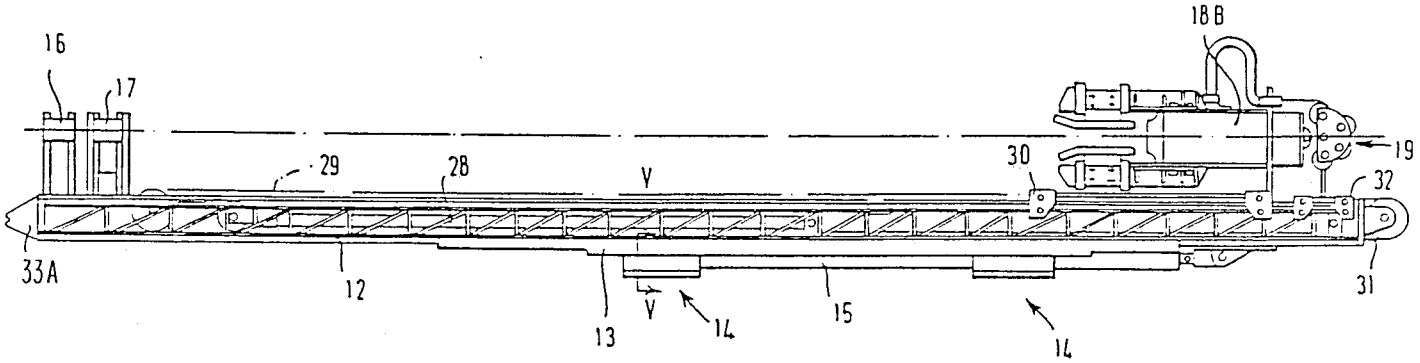
FIG. 3 is a partial side view of the machine of FIGS. 1 and 2.
Figure 4A:
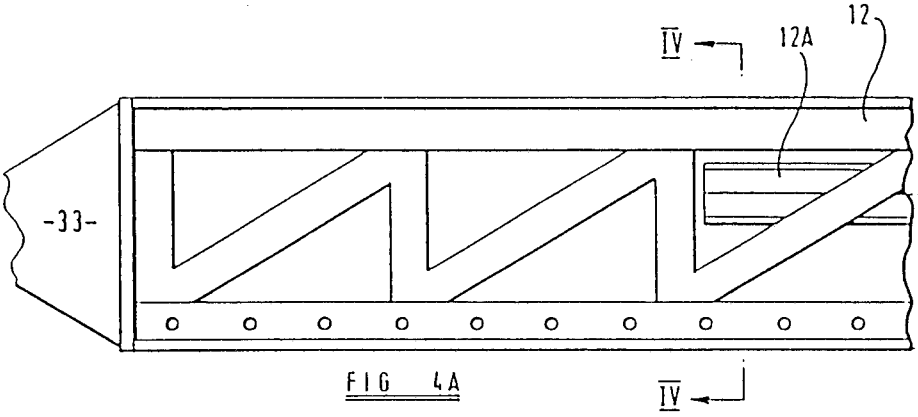
FIG. 4A is an enlarged partial side view of the machine of FIGS. 1 and 2.
Figure 4B:
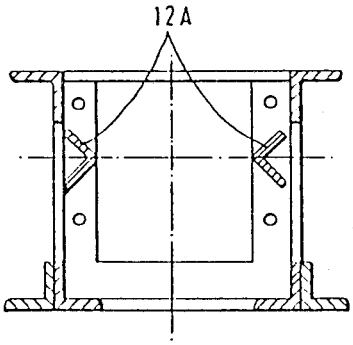
FIG. 4B is a cross-sectional view taken along the line IV—IV of FIGS. 1 and 2.

Referring now to the drawings, and in particular to FIGS. 1 and 2, a two mast combined pile driver, pile drawer and drilling machine comprises a movable carriage 1, support means 2, a mast system 5 comprising two mast units 3 and lifting means 4. The support means 2 is mounted on a turntable 1A, which is in turn rotatably mounted on the carriage by means of large ball bearings, and supports the mast system 5. The lifting means 4 comprises two hydraulic piston and cylinder arrangements 6 which are hinged to the turntable 1A at 6B to a support bearing sleeve 9A at 6C.

The carriage 1 includes a chassis 7 and wheels 8, and is also provided with an engine and hydraulic pump 34. The wheels 8 can be provided with tires, but are more preferably chain wheels provided with endless chains or articulated tracks. The carriage 1 is drivable under power.

As can clearly be seen from FIGS. 10, 10A to 10F and 11, the support means 2 comprises a rotatable, raisable and swingable tubular mast support pipe 10 which is mounted to a main bearing pipe 9 as will be described below. The bearing pipe 9 is rotatably mounted to a bracket 6'A via a rotatable bearing 33. The bracket 6'A is hinged to the turntable at 6A. Thus, when the pistons of the two hydraulic piston and cylinder arrangements 6 are extended together, the support means 2, and therefore the masts, are tilted or rotated about an axis extending parallel to the surface of the turntable, whereas when one piston is extended more than the other, the support means 2 is rotated about the bearing 33.

The support pipe 10 is connected to the bearing pipe 9 via a flanged pipe 10A. Thus, a radially outwardly extending annular flange 10 of the support pipe is bolted at 10C to an annular flange or coupling plate 10B which is itself bolted at 10D to a radially inwardly extending flange at one end of the pipe 10A. The other end of the pipe 10A has a radially outwardly extending annular flange 10A to which is bolted at 9Q an L-shaped collar 10F. The flange 10 A and collar 10 F define an annular recess receiving a flange 9 at one end of the pipe 9 and a radially outwardly extending annular flange of a bearing pipe 9H mounted coaxially within the pipe 10A. The recess also receives an annular bronze bearing plate 9K for supporting the weight of the masts.

Each end of the bearing pipe 9H has a radially extending flange 9 H for mounting a support pipe 9D coaxially within the pipe 10A. Thus, corresponding flanges of the support pipe 9A and bearing pipe 9H are bolted together at 9J while the other flange of the bearing pipe 9H is bolted at 9G to a relatively short pipe or collar 9I within which is mounted the other end of the support pipe 9D. The bearing pipe 9H is connected to the support pipe 9 by bolts at 9F. Each end of the support pipe 9D is radially enlarged relative to the remainder of the support pipe 9D to receive a respective ball and race bearing 36B.

The other end of the pipe 9 has an annular support plate 9M carrying a plate 9R bolted thereto at 9L.

Figure 10:
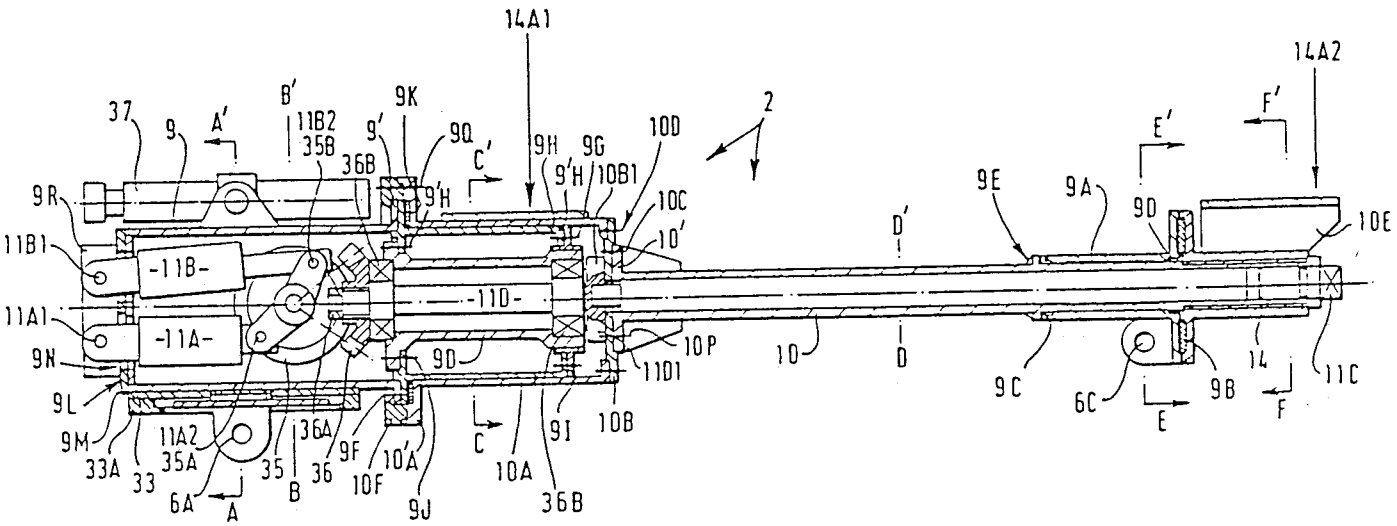
FIGS. 10, 10A, 10B, 10C, 10D, 10E, 10F are partial side view, partly in section, of support means of the machine of FIG. 1.
Figure 10A:
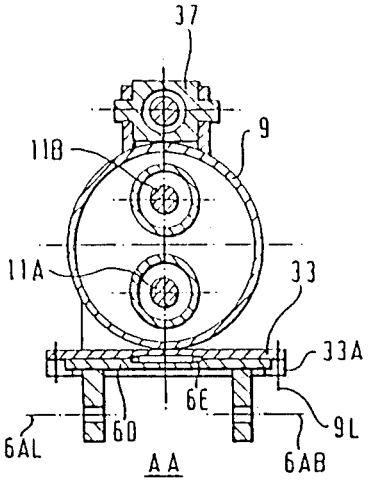
Figure 10B:
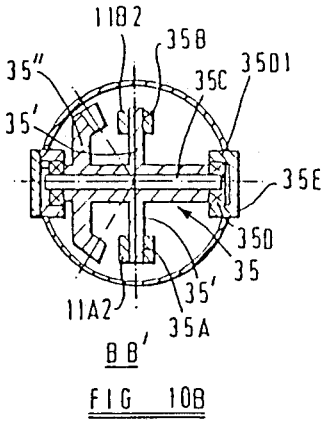

The cylinder of each of two hydraulic piston and cylinder arrangements 11A and 11B is pivotably mounted to the plate 9R by means of a respective pivot arm extending through an aperture in the plate 9M and engaging a respective hole 11A1 and 11B1 in the plate 9R. The piston of each of the hydraulic piston and cylinder arrangement 11A and 11B is pivotably connected to a drive bevel gear unit 35 by means of a respective pivot arm or hinge 11A2 and 11B2 engaging a corresponding hole 35A and 35B in a respective pivot arm 35 of the drive bevel gear unit 35 (FIG. 10B). A line joining the centers of the holes 11A1 and 11B1 intersects the axis of the bearing pipe 9.

As shown in FIG. 10B, the drive bevel gear unit 35 is mounted on a shaft each end of which is rotatably mounted to the bearing pipe 9 by means of a bearing unit comprising a tapered roller bearing 35D mounted in a bearing housing 35D1 and having bearing cover 35E. Thus, the drive bevel gear unit 35 may be rotated by actuation of the hydraulic piston and cylinder arrangements 11A and 11B as will be described below.

A bevel gear 35 of the drive bevel gear unit 35 meshes with a bevel gear of a driven bevel gear unit 36, the two bevel gears being disposed so as to be mutually perpendicular. The driven bevel gear unit 36 is splined to a coupling shaft 11D and locked in position thereon by a locking nut 36A. The coupling shaft 11D is rotatably supported in the pipe 9D by the ball and race bearings 36B, the outer races of which are fixed to the inner surface of the support pipe 9D so that the coupling shaft 11D is supported by the inner races thereof.

A universal coupling 11D1 is connected to a flanged universal coupling plate 10B1 of the coupling shaft 11D. The coupling plate 10B1 is connected to a flange end of the pipe 10 by bolts at 10C and to a radially inwardly extending flange of the flanged pipe 10A by bolts at 10D.

Figure 10C:
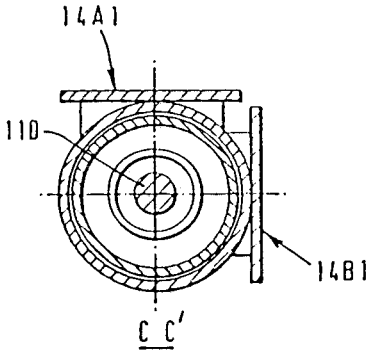
Figure 10D:
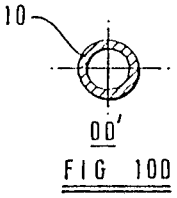
Figure 10E:
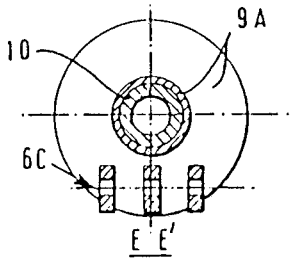
Figure 10F:
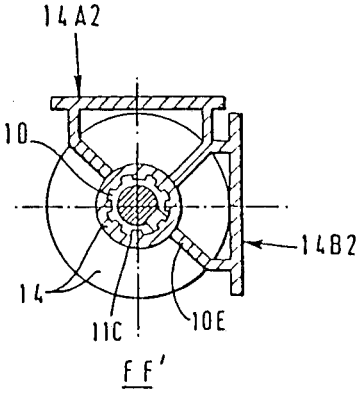
Figure 11:
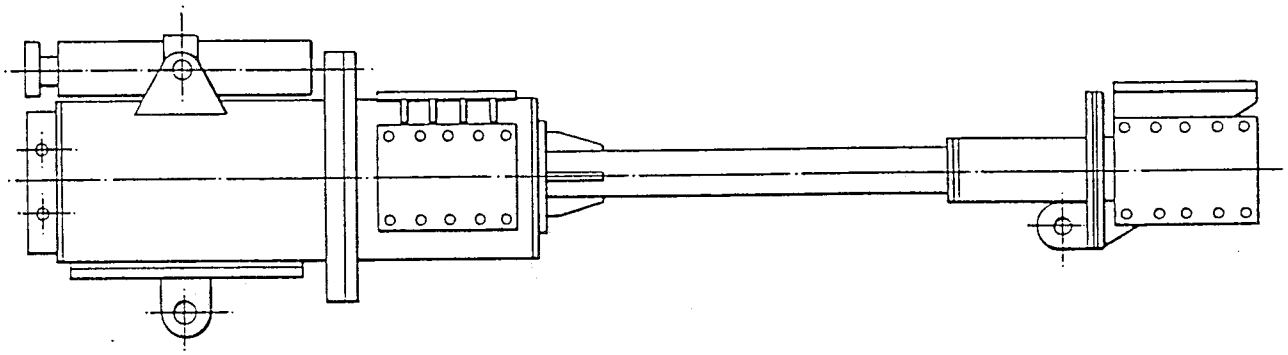
FIG. 11 is a side view of the machine of FIG. 1.
Figure 12:
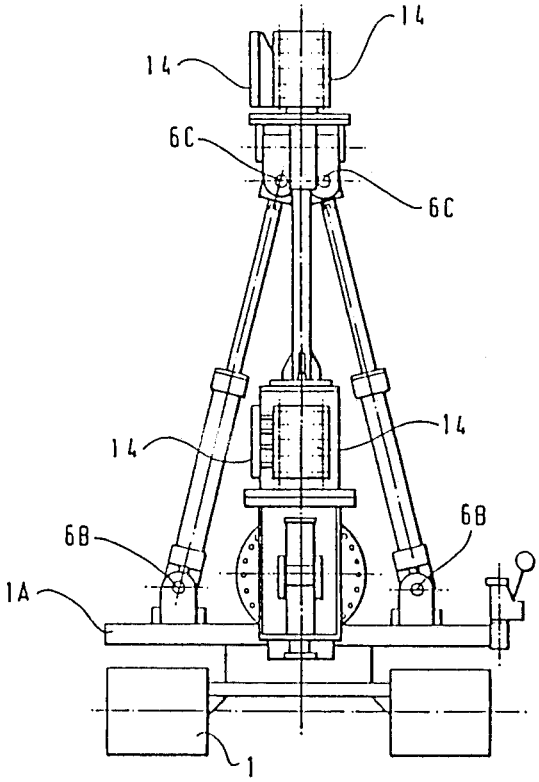
FIG. 12 is a front view of the machine (without the mast) when the mast is in a vertical position.

The other end of the pipe 10 extends through a flanged bearing sleeve 9A and is supported therein by means of bronze bushes 9C and 9D. A shoulder 9E is provided on the pipe 10 to prevent the flanged sleeve 9A sliding down the pipe 10. A further bronze plate 9B for supporting the masts during operation of the apparatus is engaged between radially outwardly extending flanges of the sleeve 9A and a further sleeve 14. The sleeve 14 is splined to the pipe 10 and locked in position by means of a locking nut 11C. A mild steel plate 10E mounted to the sleeve 14 supports two plates 14A2 and 14B2 (FIG. 10F) which plates in turn support the weight of the two masts. Two further mast support plates 14A1 and 14B1 are mounted to the flanged pipe 10A as shown in FIG. 10C.

The support means 2 is pivotably mounted to the turntable 1A (FIGS. 1 and 2) at pivot points 6A and 6C. Thus, as shown in FIGS. 10 and 10A, a pair of ears 6AL and 6AR for receiving a pivot pin are welded to a round plate 6D. The round plate 6D is rotatably mounted to a round plate 33 fixed ototho bearing pipe 9. As shown in FIGS. 10A, the round plates 6D and 33 have opposed central recesses receiving a ring bushing 6E and a L-cross section ring plate collar 33A is bolted at 9L to the plate 33 to define a race or guide groove for the round plate 6D. The bearing pipe 9 is welded to the plate 33 which may be made of steel so that the bearing plate 9 can pivot or swing about the axis of the round plate 6D.

Ears 6C are welded to the bearing pipe 9A for receiving a pivot pin to allow the support means to be pivotably connected to the hydraulic piston and cylinder arrangements 4 and 6 (FIG. 1).

A foot in the form of a hydraulic piston and cylinder arrangement or jack 37 is provided on the bearing pipe 9 to support the weight of the support means and mast system when the mast system is a vertical position.

As shown in FIG. 10 the piston rod of the cylinder 11A is being retracted while the piston rod of cylinder 11B is being extended so the bevel gear 35 is being rotated in a clockwise direction. When the valve controlling oil flow (not shown) is turned to its other position, the piston rod of the cylinder 11B will be retracted and the piston rod of cylinder 11A will be extended so that bevel gear 35 will be rotated in an anti-clockwise direction. The smaller bevel gear 36 is driven by the bevel gear 35 so that, because of their different pitch diameters, the bevel gear 36 rotates through 90° as the bevel gear 35 rotated through 75°. The driven bevel gear 36 is connected to one end of the shaft 11D. The other end of the shaft 11D has a universal coupling 11D1 which drives the universal coupling 10B1. The universal coupling 10B1 is welded to the plate 10B while the plate 10B is mounted on the mast support pipe 10 by bolts at 10P. Thus, when the bevel gear 36 rotates in a clockwise direction the mast support pipe 10 also rotates in a clockwise direction. The mast support flange sleeve 14 is splined to the flange pipe 10, so the sleeve 14 will rotate as the pipe 10 rotates. The mast support tables 14A1 and 14A2 are disposed at an angle of 90° to mast support tables 14B1 and 14B2, respectively, and all the tables are at the same level and with the same distance from the axis of the mast support pipe 10. Thus, the two masts will swing or rotate as the mast support pipe 10 swings or rotates.

Figure 5:
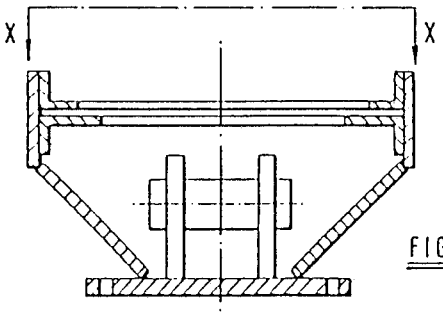
FIG. 5 is a partial cross-sectional view taken along the line V—V of FIG. 3.
Figure 5A:
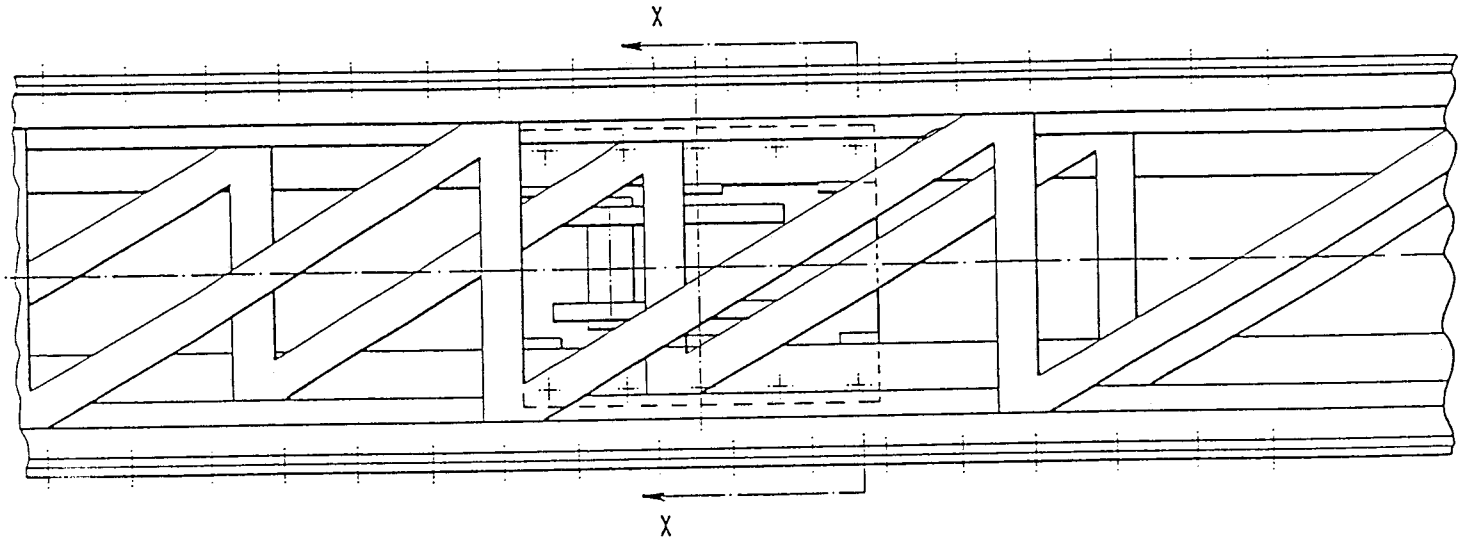
FIG. 5A is a partial cross-sectional view taken along the arrow XX in FIG. 5.
Figure 6:
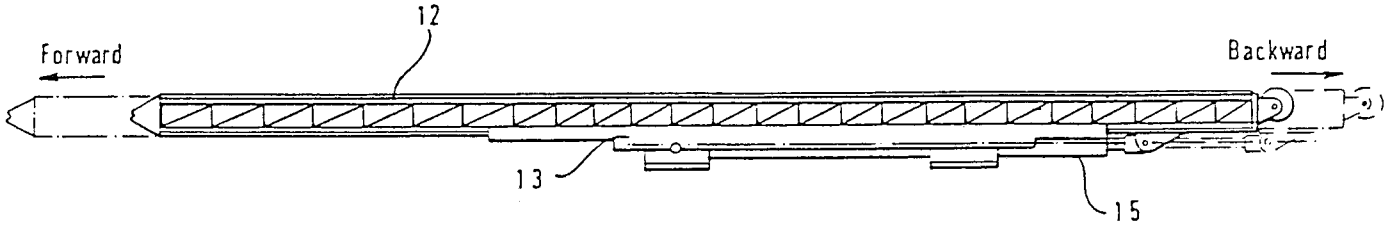
FIG. 6 is a partial side view of the part of the machine shown in FIG. 3, showing relative movement.

Referring now to FIGS. 3 to 7, each mast unit 3 comprises a mast 12 having a nose 33A, which mast 12 slides on a respective guide rail 13 which is fixed to the mast support 10 by means of brackets 14 and surrounds a hydraulic piston and cylinder arrangement 15 for sliding the mast 12 along the rail 13, as shown in FIG. 6. The mast 12 is of rectangular cross-section, for example 24"×20" (61 cm×51 cm), and comprises, for example structural steel or cast material welded together into a frame. Preferably, the mast 12 comprises angle bars and plate steel connected by nuts and bolts and, as can be seen in FIGS. 4A and 4B, is provided with a pair of feed cylinder guide rails 12A. The guide rail 13 may be constructed from a channel section beam and angle bars, also connected by nuts and bolts, as can be seen in FIGS. 5 and 5A. The power of the mast sliding piston and cylinder arrangement 15 depends on immediate requirements but the tractive force is typically about 15 tons ($1.5\times10^5$ N) forwards and about 20 tons ($2\times10^5$ N) backwards. The internal diameter of the cylinder 15 ranges from 2" to 6" (from 5 cm to 15 cm). When the internal diameter of the cylinder 15 is 5" (13 cm) the hydraulic pressure is 2200 p.s.i. ($1.5\times10^7$ N/m$^2$).

A travelling cradle 30 is provided on each of the masts 12 and can be moved along the respective mast 12 by means of a feed hydraulic piston and cylinder arrangement 28. A head 18A such as a rotary head or a percussion head is mounted on the cradle 30 of one of the two masts 12, and a drilling tool 27, including a drill rod and a drill bit, is connected to the head 18A. Alternatively, a jet grouting tool or other tool could be connected to the head 18A.

Figure 7:
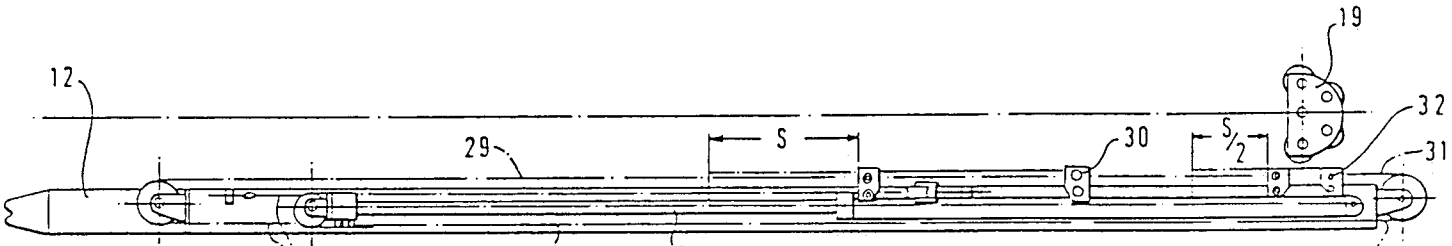
FIG. 7 is a side view of the part of the machine shown in FIGS. 4A and 4B, showing relative movement.

Referring now to FIG. 7, a hose reel 19 for hydraulic hose is mounted on a hose reel cradle 32 which is connected to a hose reel cradle wire 31. The travelling cradle 30, which is movable with respect to the mast 12 by means of the feed cylinder 38, is connected to a feed wire 29. The arrangement is such that movement of the cradle 30 through a distance S is accompanied by movement of the hose reel cradle 32 through a distance $S/_2$.

Figure 8:
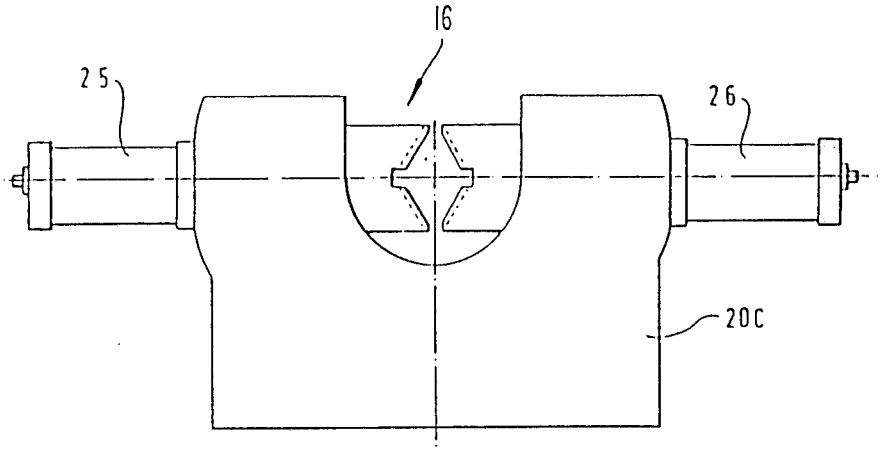
FIGS. 8, 8A, 8B are a cross-sectional view taken along the line VIII—VIII of FIG. 1.
Figure 8A:
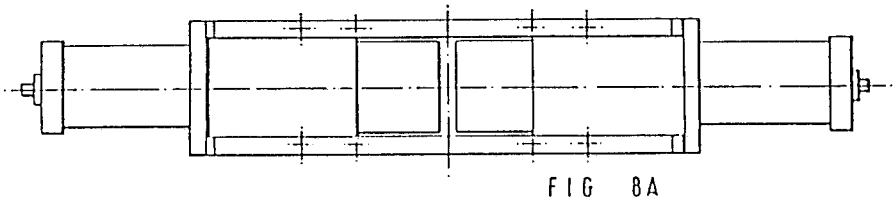
Figure 8B:
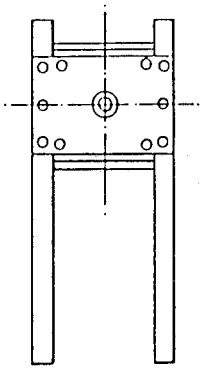

Referring now to FIGS. 8, 8A and 8B an hydraulic clamp 16 is mounted near the nose of the mast 12 carrying the drilling tool 27 and comprises a pair of hydraulic piston and cylinder arrangements 25, 26 and a frame 20C which is fixed on the mast 12. The clamp 16 can clamp a drilling pipe, a pile or the like of between 2½" and 9" (6 cm and 23 cm) external diameter.

Figure 9:
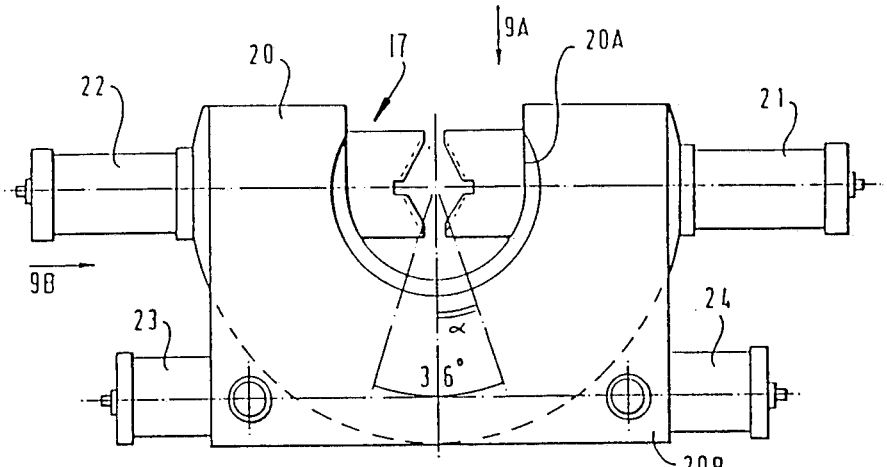
FIGS. 9, 9A, (b are a cross-sectional view taken along the line IX—IX of FIG. 1.
Figure 9A:
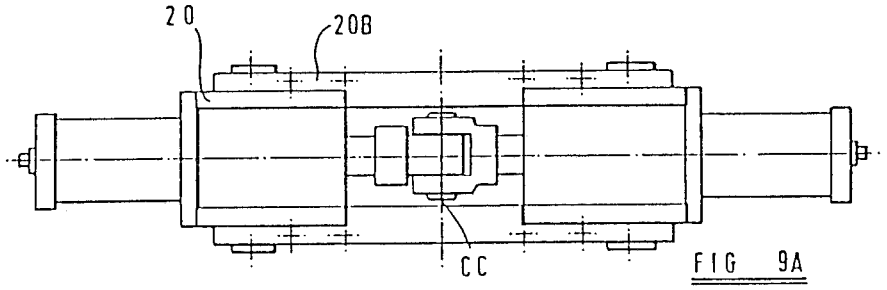
Figure 9B:
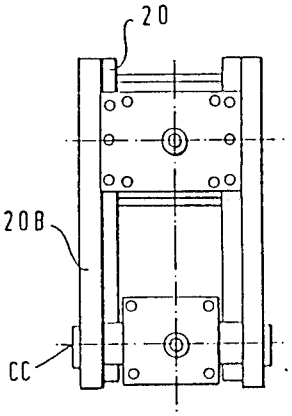

Turning now to FIGS. 9, 9A and 9C a turning unit 17 is mounted between the clamp 16 and the head 18A and includes four hydraulic piston and cylinder arrangements 21, 22, 23, 24 and a U-shaped frame 20. Two of the piston and cylinder arrangements 21, 22 are mounted on the frame 20 to clamp a drilling pipe, a pile or the like. The other two piston and cylinder arrangements 23, 24 are mounted on a frame 20B which is fixed on the mast 12. The U-shaped frame 20 is rotatably supported by a bearing plate 20A and can be rotated by one piston and cylinder arrangement 23, 24 pushing and the other piston and cylinder arrangement 23, 24 pulling simultaneously on an axle CC or the U-shaped frame 20 so as to achieve either a clockwise or an anti-clockwise movement. The maximum angle of the swing is limited to an angle of 36° and the clamped pile or the like can thus be set into reciprocating motion by the two cylinders 23, 24. Within the limits imposed by the tensile strength of the mast 12, the larger the power of the cylinder 23, 24 the larger will be the torque produced. The torque of the turning unit that can be achieved is five tons meter ($5\times10^4$ N). The external diameter of the pile or the like which can be turned ranges from 2½" to 9" (6 cm to 23 cm).

In use, the clamp 16 clamps a drilling pipe or the like, the mast piston and cylinder arrangement 15 generates a large pulling force to pull out the pipe from the bore hole, and, if the pipe cannot be pulled out, the clamp 16 is loosened and the turning unit 17 is used to effect a reciprocal rotating motion. The pipe can then be loosened and pulled out. This arrangement can also be used for pile drawing.

A pneumatic hammer 18B is mounted on the travelling cradle 30 of the other mast 12 and can be used for driving I-section beams, C-section channels, steel pipes, steel shafts, precast round or square-section concrete columns piles and the like into the ground.

Returning now to FIG. 1, two or more mast units can be mounted at any desired angle on the outside of the mast support 10, so that a large number of holes can be drilled in half the time an ordinary one-mast machine takes. Productivity can therefore be increased. As shown, the angle between the two mast units 3 is about 90°. This angle is preferred for this size and capacity of machine and also ensures that the mast units 3 are not too close together or far apart. Preferably, the mast support 10 can rotate 45° clockwise and 45° anticlockwise, giving a maximum turning angle of 90°. The drilling position can thus be adjusted without moving the machine which also improves efficiency and productivity. The support means 2 can be moved by the two hydraulic piston and cylinder arrangements 6, the lengths of which can be adjusted to achieve different angles of inclination to the ground. The angle of inclination of each mast 12 to the ground can thus vary between 0° and 90°, for drilling at different angles. Also, the support means 2 is rotatable from side to side on a bearing 33, by extending one piston and cylinder arrangement 6 more than the other, 15° clockwise and 15° anticlockwise. Thus, the machine can work in any direction and at any inclination. This machine can further be used as a crane to lift weight up to 2 tons (2032 Kg), as well as for shield drilling, horizontal piling, water well drilling, dewatering, anchoring,grouting overburden drilling and so on. It will be appreciated that each cradle 30 can be used to support various tools and drive means therefor.

It is readily apparent that the above-described pile driver, pile drawer and/or drilling machine meets all of the objects mentioned above and also has the advantage of wide commercial utility. It should be understood that the specific form of the invention hereinabove described is intended to be representative only, as certain modification within the scope of these teachings will be apparent to those skilled in the art.

Accordingly, reference should be made to the following claims in determining the full scope of the invention.

What is claimed is:

1. A machine comprising a chassis carrying a turntable rotatably mounted for rotation about a vertical axis on said chassis, an elongated lifting and/or tool carrying means and support means for the lifting and/or tool carrying means, wherein the support means is mounted to a surface of the turntable so as to be rotatable with said turntable and rotatable relative to the turntable about first and second non-parallel axes irrespective of the orientation of the lifting and/or tool carrying means relative to the said surface, the orientation of the first said axes of rotation being dependent on the rotation of the support means about the second of the axes, wherein the lifting and/or tool carrying means is rotatable with respect to the support means.

2. A machine according to claim 1, wherein the said first and second axes are interrelated so that, in use, when the support means is rotated through 90° about the second of said axes, the first of said axis is rotated through 90°.

3. A machine according to claim 1, wherein when the axis of the elongate lifting and/or tool carrying means lies parallel to the turntable surface, the said first axis extend perpendicularly of the turntable surface, the said second axis lying in or parallel to the turntable surface.

4. A machine according to claim 3, wherein said support means is rotatable about said second axis by means of raising means.

5. A machine according to claim 4, wherein said support means is rotatable about said second axis through not more than 90°.

6. A machine according to claim 4, wherein said support means is rotatable about said second axis by means of said raising means.

7. A machine according to claim 6, wherein said support means is rotatable through not more than 30° about said first axis.

8. A machine according to claim 6 or 7, wherein said raising means comprises one or more fluid operated piston and cylinder arrangements, one of said piston and cylinder of said arrangements being pivotally connected to the turntable and the other of said piston and cylinder of said arrangements being pivotally connected to said support means, said support means being elongate and being connected to the turntable at a point remote from the pivotal connections between said support means and said piston and cylinder arrangements by a mounting capable of rotation about said first and second non-parallel axes.

9. A machine according to claim 8 wherein said mounting comprises a rotatable bearing fixed to a pivotal connection mounted to said turntable.

10. A machine according to claim 8, wherein said support means comprises two members one of which members is rotatably mounted on the other, and wherein the lifting and/or tool carrying means is fixed to said rotatable member.

11. A machine according to claim 10, wherein said rotatable member is rotatable by hydraulic or pneumatic means.

12. A machine according to claim 4, 5, 6 or 7, wherein said raising means comprises one or more fluid operated piston and cylinder arrangements.

13. A machine according to claim 1, wherein said lifting and/or tool carrying means is rotatable with respect to said support means through not more than 90°.

14. A machine according to claim 1, which comprises more than one lifting an/or tool carrying means.

15. A machine according to claim 14, which comprises two lifting and/or tool carrying means having a mutual angular separation with respect to said support means of 90°.

16. A machine according to claim 14, wherein a pneumatic hammer is mounted on said lifting and/or tool carrying means for driving a pile.

17. A machine according to claim 1, wherein said lifting and/or tool carrying means comprises a mast which is rotatable with respect to said support means about the axis of said mast or about an axis parallel to said mast.

18. A machine according to claim 17, wherein said lifting and/or tool carrying means further comprises a guide rail along which said mast is slidable, and means for sliding said mast along said guide rail.

19. A machine according to claim 18, wherein said sliding means comprises a fluid operated piston and cylinder arrangement.

20. A machine according to claim 17, wherein clamping means are mounted to said mast of said lifting and/or carrying means.

21. A machine according to claim 20, wherein said clamping means comprises two fluid operated piston and cylinder arrangements.

22. A machine according to claim 17, which further comprises gripping and turning means mounted on said mast.

23. A machine according to claim 22, wherein said gripping and turning means comprises gripping means comprising a frame which is rotatably mounted on said mast and first and second fluid operated piston and cylinder arrangements mounted on said frame, and turning means consisting of third and fourth fluid operated piston and cylinder arrangements for rotating said frame relative to said mast.

24. A machine according to claim 17, wherein said mast is a drilling mast having means for supporting and driving a drilling tool.

25. A machine according to claim 1, wherein said turntable is mounted on a carriage powered for moving said machine across a surface.

26. A machine comprising a chassis carrying a turntable, an elongated lifting and/or tool carrying means and support means for the lifting and/or tool carrying means, wherein the support means is mounted to a surface of the turntable about first and second non-parallel axes irrespective of the orientation of the lifting and/or tool carrying means relative to the said surface, the orientation of the first of said axes of rotation being dependent on the rotation of the support means about the second of said axes, wherein the lifting and/or tool carrying means is rotatable with respect to the support means, the axis of the elongated lifting and/or tool carrying means lying parallel to the turntable surface, the said first axis extending perpendicularly to the turntable surface, the said second axis lying in or parallel to the turntable surface, said support means being rotatable about said second axis by means of raising means, said support means being rotatable about said second axis through not more than 90°, said support means being rotatable through not more than 30° about said first axis, said raising means comprising one or more fluid operated piston and cylinder arrangements, one of said piston and cylinder of said arrangements being pivotally connected to the turntable and the other of said piston and cylinder of said arrangements being pivotally connected to said support means, said support means being elongate and being connected to the turntable at a point remote from the pivotal connections between said support means and said piston and cylinder arrangements by a mounting capable of rotation about said first and second non-parallel axes, said support means comprising two members, one of which members is rotatably mounted on the other, and wherein the lifting and/or tool carrying means is fixed to said rotatable member, said rotatable member being rotatable by hydraulic or pneumatic means, said hydraulic or pneumatic means comprising two further piston and cylinder arrangements pivotally connected to a first gear and operable in opposition so that, in use, when the piston of one of said further piston and cylinder arrangements is extended said first gear rotates in one direction, and when the piston of the other of said piston and cylinder arrangements is extended said first gear rotates in the opposite direction, said first gear meshing with a second gear disposed at right angles thereto, said second gear being connected to rotate said rotatable member.

27. A machine which comprises a lifting and/or tool-carrying means and support means therefor, wherein the support means is rotatable about first and second non-parallel axes and comprises two members, one of said members is rotatably mounted on the other of said members, and wherein the lifting and/or tool carrying means is fixed to said rotatable member, said rotatable member being rotatably by hydraulic or pneumatic means comprising two piston and cylinder arrangements pivotally connected to a first gear and operable in opposition so that, in use, when the piston of one of said piston and cylinder arrangements is extended said first gear rotates in one direction and when the piston of the other of said piston and cylinder arrangement is extended said first gear rotates in the opposite direction, said first gear meshing with a second gear disposed at right angles to said first gear, said second gear being connected for rotating said rotatable member.

28. A machine according to claim 27, wherein said second gear is fixed to a support shaft which is joined to said rotatable member by means of a universal coupling.

* * * * *